US009316953B2

(12) United States Patent
Hirayama et al.

(10) Patent No.: US 9,316,953 B2
(45) Date of Patent: Apr. 19, 2016

(54) WET-TYPE IMAGE FORMATION APPARATUS AND A CHARGING DEVICE FOR CHARGING A RECORDING MEDIUM, AND METHOD

(71) Applicant: KONICA MINOLTA, INC., Chiyoda-ku (JP)

(72) Inventors: Junya Hirayama, Takarazuka (JP); Shigeo Uetake, Takatsuki (JP); Yuji Kamoda, Ibaraki (JP); Hirofumi Nakagawa, Takatsuki (JP); Toshiya Natsuhara, Takarazuka (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/253,000

(22) Filed: Apr. 15, 2014

(65) Prior Publication Data

US 2014/0321892 A1 Oct. 30, 2014

(30) Foreign Application Priority Data

Apr. 25, 2013 (JP) ..... 2013-092298

(51) Int. Cl.
*G03G 15/00* (2006.01)
*G03G 15/20* (2006.01)
*G03G 15/11* (2006.01)

(52) U.S. Cl.
CPC ..... *G03G 15/11* (2013.01); *G03G 15/2021* (2013.01); *G03G 15/657* (2013.01)

(58) Field of Classification Search
CPC ..... G03G 15/02; G03G 15/0208; G03G 15/0216; G03G 15/10; G03G 15/101; G03G 15/102; G03G 2215/0626; G03G 2215/0629; G03G 2215/0631; G03G 2215/0084; G03G 2215/0088
See application file for complete search history.

(56) References Cited

U.S. PATENT DOCUMENTS 3,714,665 A * 1/1973 Mutschler et al. ..... 347/155
3,891,434 A * 6/1975 Taege et al. ..... 430/118.3

(Continued)

FOREIGN PATENT DOCUMENTS

JP 55-087542 12/1978
JP 55-009505 1/1980

(Continued)

OTHER PUBLICATIONS

Notice of Grounds of Rejection issued in corresponding Japanese Patent Application No. 2013-092298, mailed Apr. 21, 2015, and English translation thereof.

(Continued)

*Primary Examiner* — Clayton E Laballe
*Assistant Examiner* — Victor Verbitsky
(74) *Attorney, Agent, or Firm* — Buchanan Ingersoll & Rooney PC

(57) ABSTRACT

A wet-type image formation apparatus includes: an intermediate transfer body that carries a toner image including toner particles, which are charged to have a first polarity, and a carrier liquid; a transferring roller that transfers a toner image onto a transfer surface of a recording medium; a charging device that charges the transfer surface to have a second polarity opposite to the first polarity; and a fixing mechanism that fixes the toner image. The fixing mechanism includes a noncontact heating device. The noncontact heating device forms the toner particles into a film such that the toner particles and the carrier liquid are separated from each other by heating the toner image when the toner particles charged to the first polarity is electrostatically adsorbed onto the transfer surface charged to have the second polarity. The film of the toner particles is fixed onto the transfer surface.

10 Claims, 7 Drawing Sheets

(56) References Cited

U.S. PATENT DOCUMENTS

| | | | | |
|---|---|---|---|---|
| 5,659,842 | A * | 8/1997 | Hasegawa | G03G 15/0131 399/303 |
| 6,108,510 | A | 8/2000 | Nakane | |
| 6,259,887 | B1 * | 7/2001 | Awano | 399/390 |
| 2002/0159801 | A1 | 10/2002 | Nakashima et al. | |
| 2010/0086336 | A1 * | 4/2010 | Izawa | G03G 15/10 399/336 |
| 2013/0077998 | A1 * | 3/2013 | Tombs | G03G 15/34 399/130 |

FOREIGN PATENT DOCUMENTS

| | | | |
|---|---|---|---|
| JP | 60053979 | A * | 3/1985 |
| JP | 04-369675 | | 12/1992 |
| JP | 11-265131 | A | 9/1999 |
| JP | 2001-305868 | A | 11/2001 |
| JP | 2001-356613 | A | 12/2001 |
| JP | 2003-098864 | A | 4/2003 |
| JP | 2003-167456 | | 6/2003 |
| JP | 2009-282280 | | 12/2009 |
| JP | 2012-145818 | A | 8/2012 |

OTHER PUBLICATIONS

Office Action (Final Decision for Rejection) issued on Nov. 10, 2015, by the Japanese Patent Office in corresponding Japanese Patent Application No. 2013-092298, and an English Translation of the Office Action. (7 pages).

* cited by examiner

FIG.13

| | CARRIER LIQUID | CHARGING DEVICE | TONER POLARITY | POLARITY OF TRANSFER SURFACE OF RECORDING MEDIUM | ON/OFF OF NONCONTACT HEATING DEVICE | PROVISION OF REMOVING MECHANISM | PROVISION OF PRESSURIZING AND HEATING MECHANISM | LOW-TEMPERATURE OFFSET | HIGH-TEMPERATURE OFFSET | DEGREE OF TRANSPARENCY |
|---|---|---|---|---|---|---|---|---|---|---|
| EXAMPLE1 | P−40 | COROTRON-COROTRON | POSITIVE | NEGATIVE | ON | PROVIDED | PROVIDED | GOOD | GOOD | GOOD |
| EXAMPLE2 | P−40 | COROTRON-GROUND ELECTRODE | POSITIVE | NEGATIVE | ON | PROVIDED | PROVIDED | GOOD | GOOD | GOOD |
| EXAMPLE3 | IsoparL | COROTRON-COROTRON | POSITIVE | NEGATIVE | ON | NOT PROVIDED | PROVIDED | GOOD | GOOD | GOOD |
| EXAMPLE4 | P−40 | COROTRON-COROTRON | POSITIVE | NEGATIVE | ON | PROVIDED | NOT PROVIDED | — | — | GOOD |
| EXAMPLE5 | IsoparL | COROTRON-COROTRON | POSITIVE | NEGATIVE | ON | NOT PROVIDED | NOT PROVIDED | — | — | GOOD |
| COMPARATIVE EXAMPLE1 | P−40 | — | POSITIVE | — | ON | PROVIDED | PROVIDED | NOT GOOD | GOOD | NOT GOOD |
| COMPARATIVE EXAMPLE2 | IsoparL | — | POSITIVE | — | ON | NOT PROVIDED | PROVIDED | GOOD | NOT GOOD | NOT GOOD |
| COMPARATIVE EXAMPLE3 | P−40 | COROTRON-COROTRON | POSITIVE | POSITIVE | ON | PROVIDED | PROVIDED | NOT GOOD | GOOD | NOT GOOD |
| COMPARATIVE EXAMPLE4 | IsoparL | COROTRON-COROTRON | POSITIVE | POSITIVE | ON | NOT PROVIDED | PROVIDED | GOOD | NOT GOOD | NOT GOOD |
| COMPARATIVE EXAMPLE5 | P−40 | COROTRON-COROTRON | POSITIVE | NEGATIVE | OFF | PROVIDED | PROVIDED | NOT GOOD | NOT GOOD | NOT GOOD |
| COMPARATIVE EXAMPLE6 | IsoparL | COROTRON-COROTRON | POSITIVE | NEGATIVE | OFF | NOT PROVIDED | PROVIDED | GOOD | NOT GOOD | NOT GOOD |
| COMPARATIVE EXAMPLE7 | P−40 | — | POSITIVE | — | ON | PROVIDED | NOT PROVIDED | — | — | NOT GOOD |
| COMPARATIVE EXAMPLE8 | P−40 | COROTRON-COROTRON | POSITIVE | POSITIVE | ON | PROVIDED | NOT PROVIDED | — | — | NOT GOOD |
| COMPARATIVE EXAMPLE9 | IsoparL | — | POSITIVE | — | ON | NOT PROVIDED | NOT PROVIDED | — | — | NOT GOOD |
| COMPARATIVE EXAMPLE10 | IsoparL | COROTRON-COROTRON | POSITIVE | POSITIVE | ON | NOT PROVIDED | NOT PROVIDED | — | — | NOT GOOD |

WET-TYPE IMAGE FORMATION APPARATUS AND A CHARGING DEVICE FOR CHARGING A RECORDING MEDIUM, AND METHOD

This application is based on Japanese Patent Application No. 2013-092298 filed with the Japan Patent Office on Apr. 25, 2013, the entire content of which is hereby incorporated by reference.

BACKGROUND OF THE INVENTION

1. Field of the Invention

The present invention relates to a wet-type image formation apparatus that forms a toner-fixed image using a liquid developer including a carrier liquid and toner particles.

2. Description of the Related Art

In an image formation apparatus employing an electrophotography method, an electrostatic latent image formed on a photoconductor using a developing device is developed by toner. A toner image, which is formed by the toner adhering to the electrostatic latent image, is transferred and fixed onto a recording medium. In this way, the toner-fixed image is formed. Conventionally and generally used in the image formation apparatus employing the electrophotography method are: a dry-type developing method employing powder toner; and a wet-type developing method employing a liquid developer.

Such an image formation apparatus of the electrophotography method is required to efficiently form a toner-fixed image, which is finally formed, with less distortion in the toner-fixed image. To attain this, conveying means for electrostatically adsorbing and conveying the recording medium is employed to prevent displacement of the toner-fixed image and achieve efficient image formation.

Examples of a document disclosing an image formation apparatus employing such conveying means include Japanese Laid-Open Patent Publication No. 11-265131, Japanese Laid-Open Patent Publication No. 2001-356613, and Japanese Laid-Open Patent Publication No. 2001-305868.

In a dry-type image formation apparatus employing the dry-type developing method as disclosed in Japanese Patent Laying-Open No. 11-265131, a toner image is transferred onto a recording medium with the recording medium being electrostatically adsorbed to the conveying means. In doing so, the conveying speed is changed depending on a type of toner image, and the transferred toner image is fixed onto the recording medium using only a pressurizing and heating mechanism.

In a wet-type image formation apparatus employing the wet-type developing method as disclosed in each of Japanese Laid-Open Patent Publication No. 2001-356613 and Japanese Laid-Open Patent Publication No. 2001-305868, a toner image is simultaneously transferred and fixed onto a recording medium with the recording medium being electrostatically adsorbed to the conveying means.

In recent years, an image formation apparatus used for an office printer, an on-demand printing apparatus, or the like for massive printing is required to attain higher efficiency, higher image quality, and higher resolution. To achieve this, a wet-type image formation apparatus has begun to be used which employs a liquid developer including toner particles having size smaller than that of toner particles of powder toner employed in a dry-type image formation apparatus and provides less distortion in the toner-fixed image.

The liquid developer used in the wet-type image formation apparatus includes toner particles and a carrier liquid. In the wet-type image formation apparatus, an electrostatic latent image is developed using this liquid developer to form a toner image, which is then transferred and heated to fix it onto a recording medium. In this way, a toner-fixed image is formed.

However, if an excess of carrier liquid is left in the toner image when heating and fixing the toner image after the transfer, the toner particles are less likely to be melted and combined with each other, with the result that the toner image is fixed on the recording medium at a low strength and the toner-fixed image is therefore likely to be detached. Moreover, the particles not sufficiently melted provide roughness in the image portion, thus resulting in a toner-fixed image having a low degree of transparency. Meanwhile, when heating and fixing under application of pressure, the following phenomenon takes place: toner particles not sufficiently melted and combined with each other adhere to a fixing member. In particular, this phenomenon is likely to take place when the fixing member is set at a low temperature and the carrier liquid is less likely to be volatilized. Hence, the phenomenon is called "low-temperature offset".

On the other hand, even in the case where there is a small amount of carrier liquid when heating and fixing the toner image after the transfer, the carrier liquid remaining on the surfaces of the toner particles prevents the toner particles from being combined with each other. Accordingly, the toner image is fixed onto the recording medium at a low strength and the toner-fixed image is likely to be detached and scratched. Moreover, roughness is left in the image portion, thus resulting in a toner-fixed image having a low degree of transparency. When heating and fixing it under application of pressure, bonding strength between the toner particles is not sufficient, with the result that part of melted toner particles are divided by the fixing member at a boundary portion between the toner particles. This results in the following phenomenon: the divided toner particles adhere to the fixing member. In particular, this phenomenon is likely to take place when the fixing member is set at a high temperature and the carrier liquid is likely to be volatilized. Hence, the phenomenon is called "high-temperature offset".

Here, none of the image formation apparatuses disclosed in Japanese Laid-Open Patent Publication No. 11-265131, Japanese Laid-Open Patent Publication No. 2001-356613, and Japanese Laid-Open Patent Publication No. 2001-305868 sufficiently considers suppression of the low fixing strength and the offset phenomena including the low-temperature offset and the high-temperature offset.

SUMMARY OF THE INVENTION

The present invention has an object to provide a wet-type image formation apparatus that prevents formation of an image having a low fixing strength and a low degree of transparency and suppresses such an offset phenomenon that toner particles adhere to a fixing member.

A wet-type image formation apparatus according to the present invention forms a toner-fixed image on a recording medium while conveying the recording medium. The wet-type image formation apparatus according to the present invention includes: an image carrier that carries a toner image including toner particles, which are charged to have a first polarity, and a carrier liquid; a transfer mechanism that is disposed to face the image carrier with a conveying path for the recording medium being interposed therebetween, that forms a nip portion between the transfer mechanism and the image carrier when being pressed against the image carrier, and that transfers the toner image carried by the image carrier onto a transfer surface of the recording medium conveyed to the nip portion; a charging device that charges the transfer surface to have a second polarity opposite to the first polarity before the recording medium is conveyed to the nip portion; and a fixing mechanism that fixes the toner image transferred onto the transfer surface. The fixing mechanism includes a noncontact heating device that heats the toner image without contact with the toner image transferred onto the transfer surface. The noncontact heating device forms the toner particles into a film such that the toner particles and the carrier liquid are separated from each other by heating the toner image when the toner particles having been charged to have the first polarity are electrostatically adsorbed onto the transfer surface charged to have the second polarity. The film of the toner particles is fixed on the transfer surface.

Preferably in the wet-type image formation apparatus according to the present invention, the charging device includes a pair of corona chargers facing each other with the conveying path for the recording medium being interposed therebetween. In this case, one of the pair of corona chargers is preferably disposed at a side of the transfer surface of the recording medium to charge the transfer surface to have the second polarity, and the other of the pair of corona chargers is preferably disposed at a side opposite to the transfer surface of the recording medium to charge a surface of the recording medium, which is opposite to the transfer surface, to have the first polarity.

Preferably in the wet-type image formation apparatus according to the present invention, the charging device includes a corona charger and a ground electrode facing each other with the conveying path for the recording medium being interposed therebetween. In this case, the corona charger is preferably disposed at a side of the transfer surface of the recording medium to charge the transfer surface to have the second polarity, and the ground electrode is preferably in abutment with a surface of the recording medium opposite to the transfer surface such that the surface of the recording medium opposite to the transfer surface slides on the ground electrode.

Preferably in the wet-type image formation apparatus according to the present invention, the fixing mechanism further includes a pressurizing and heating mechanism disposed downstream of the noncontact heating device in the conveying direction of the recording medium, and the pressurizing and heating mechanism presses and heats the film of the toner particles.

The wet-type image formation apparatus according to the present invention preferably further includes a removing mechanism that removes the carrier liquid separated by forming the toner particles into the film using the noncontact heating device.

Preferably in the wet-type image formation apparatus according to the present invention, the removing mechanism is configured to be capable of switching between a state in which the carrier liquid is able to be removed and a state in which the carrier liquid is not able to be removed.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 13 shows conditions and results of an experiment conducted to verify an effect of the present invention.

DESCRIPTION OF THE PREFERRED EMBODIMENTS

Figure 1:
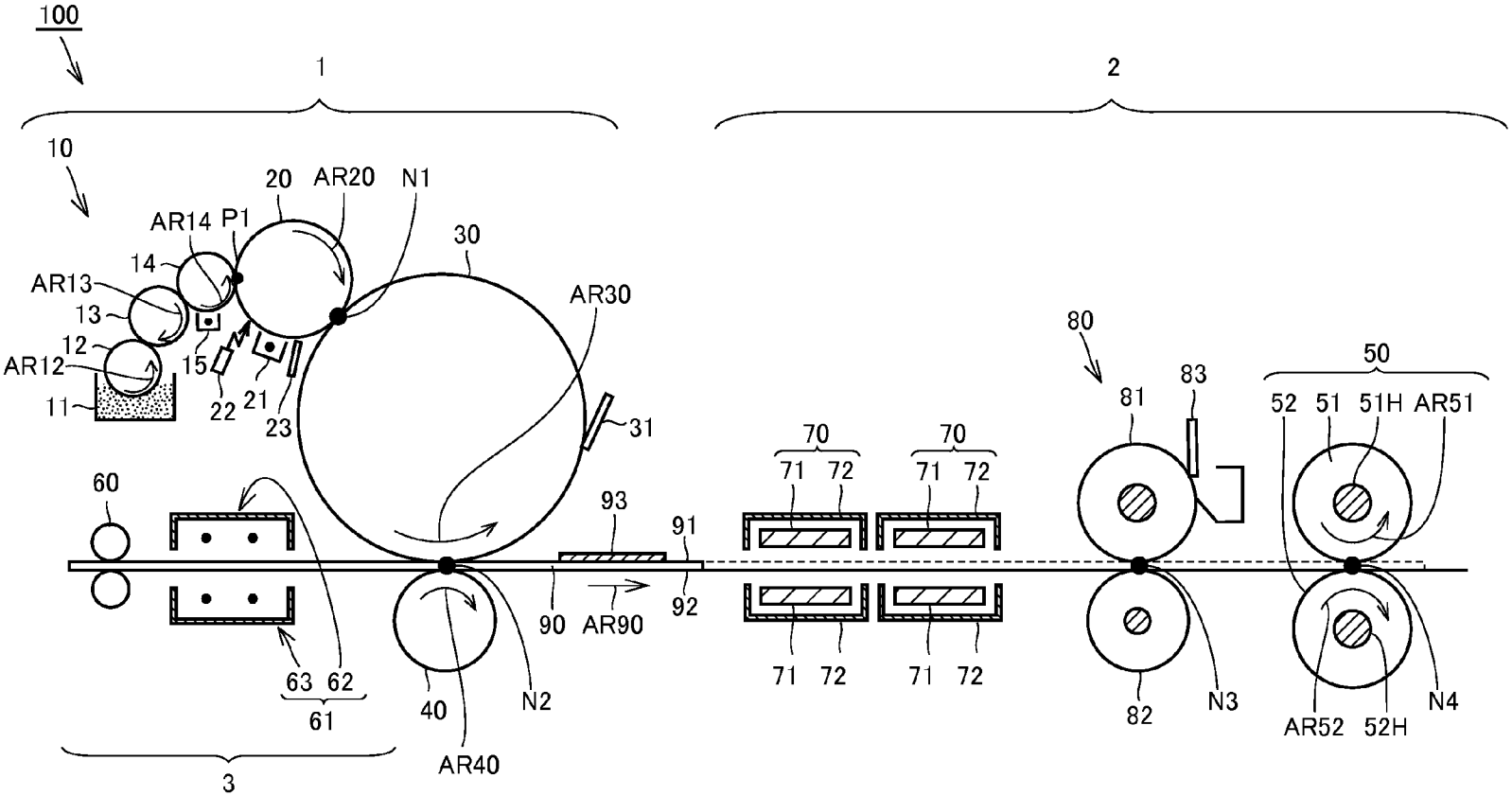
FIG. 1 is a schematic view of a wet-type image formation apparatus according to a first embodiment of the present invention.

The following fully describes embodiments and modification of the present invention and a comparative form with reference to figures. It should be noted that in the below-described embodiments, modification and comparative form, the same or common portions are given the same reference characters in the figures and are not described repeatedly.

First Embodiment

FIG. 1 is a schematic view of a wet-type image formation apparatus according to the present embodiment. With reference to FIG. 1, the wet-type image formation apparatus according to the present embodiment will be described.

As shown in FIG. 1, wet-type image formation apparatus 100 according to the present embodiment includes: an image formation unit 1 that forms a toner image by developing an electrostatic latent image on a below-described photoconductor 20 and that secondarily transfers the formed toner image onto a recording medium 90; a fixing mechanism 2 that fixes that secondarily transferred toner image 93 onto recording medium 90; and a pre-transfer processing apparatus 3 that provides a pre-process to recording medium 90 before the secondary transfer.

Pre-transfer processing apparatus 3 includes conveying means 60 and a charging device 61. Conveying means 60 includes two conveying rollers facing each other with a conveying path for recording medium 90 being interposed therebetween. The two conveying rollers convey recording medium 90 to a below-described secondary transfer position N2 of image formation unit 1.

Charging device 61 is capable of charging recording medium 90 without contact with recording medium 90 before recording medium 90 is transferred to secondary transfer position N2. Charging device 61 has a corotron 62 and a corotron 63 facing each other with the conveying path for recording medium 90 being interposed therebetween. Corotron 62 serves as a first corona charger and corotron 63 serves as a second corona charger.

More specifically, corotron 62 is disposed at the transfer surface 91 side of recording medium 90 onto which toner image 93 described below is transferred. Corotron 62 charges transfer surface 91 to have a second polarity opposite to a first polarity, which is a polarity of the charges of the toner particles as described below. Meanwhile, corotron 63 is disposed at the rear surface 92 side opposite to transfer surface 91. Corotron 63 charges rear surface 92 to have the first polarity, which is the same polarity as the polarity of the charges of the toner particles. It is preferable that the first polarity is positive and the second polarity is negative, but the present invention is not limited to this. The first polarity may be negative and the second polarity may be positive.

When the toner particles are positively charged, corotron 62 is fed with a negative high DC voltage by a power source (not shown) so as to negatively charge transfer surface 91 of recording medium 90. In this case, in order to positively charge rear surface 92 of recording medium 90, corotron 63 is fed with a positive high DC voltage by a power source (not shown). It should be noted that transfer surface 91 can be negatively charged by feeding corotron 62 with a negative high DC voltage and feeding corotron 62 with a high AC voltage.

Image formation unit 1 includes a liquid developing device 10, a photoconductor 20, a charging device 21, an exposure device 22, a photoconductor cleaning device 23, an intermediate transfer body 30 serving as an image carrier, an intermediate transfer body cleaning device 31, and a transferring roller 40 serving as a transfer mechanism.

Liquid developing device 10 includes a developer tank 11 containing a liquid developer therein, a feed roller 12, a delivery roller 13, a developing roller 14, and a charging device 15. Feed roller 12 is provided in contact with the liquid developer within developer tank 11. When feed roller 12 is rotated in a direction of AR12, the liquid developer is drawn up to the surface of feed roller 12. The liquid developer is held such that it adheres on the surface of feed roller 12, and is conveyed by rotation of feed roller 12 toward a portion at which feed roller 12 and delivery roller 13 face each other.

With an excessive amount of liquid developer on the surface of feed roller 12 being scraped off by a doctor blade (not shown), the liquid developer is provided from feed roller 12 to delivery roller 13. The liquid developer is held such that it adheres on the surface of delivery roller 13 and delivery roller 13 is rotated in a direction of arrow AR13, thereby conveying the liquid developer to a portion at which delivery roller 13 and developing roller 14 face each other.

Thereafter, the liquid developer on the surface of delivery roller 13 is provided from delivery roller 13 to developing roller 14, which is being rotated in a direction of arrow AR14. The liquid developer is held such that it adheres on the surface of developing roller 14 and developing roller 14 is rotated to convey the liquid developer toward a developing position P1, which is a contact point between photoconductor 20 and developing roller 14. It should be noted that the liquid developer remaining on the surface of delivery roller 13 is removed from the surface of delivery roller 13 by a cleaning blade (not shown).

Through the steps described above, the liquid developer is held such that the liquid developer is adjusted to have a uniform film thickness on the surface of developing roller 14 in the longitudinal direction. The liquid developer forms a thin layer on the surface of developing roller 14. Toner particles in the liquid developer forming the thin layer are charged to have the positive polarity, which is the first polarity, by charging device 15 before reaching developing position P1, for example.

Photoconductor 20 has a cylindrical shape with a surface having a photoconductor layer (not shown) formed thereon, and is rotated in a direction of arrow AR20. Around the outer circumference of photoconductor 20, intermediate transfer body 30, photoconductor cleaning device 23, charging device 21, exposure device 22, and liquid developing device 10 are sequentially disposed in the rotation direction of photoconductor 20.

Charging device 21 charges the surface of photoconductor 20 to have a predetermined potential. Exposure device 22 provides the surface of photoconductor 20 with light that is based on predetermined image information, and decreases a charge level in the region thus provided with the light, thereby forming an electrostatic latent image. Liquid developing device 10 employs developing roller 14 to supply the liquid developer onto the surface of photoconductor 20 on which the electrostatic latent image is formed. In this way, the electrostatic latent image is developed by the liquid developer and, as a result, a toner image is formed on the surface of photoconductor 20.

It should be noted that the liquid developer remaining on the surface of developing roller 14 is removed from the surface of developing roller 14 by the cleaning blade (not shown).

When forming the toner image, a developing bias voltage of the same polarity as that of the toner particles is applied from a power source (not shown) to developing roller 14 of liquid developing device 10. In this way, the toner particles in the liquid developer are electrostatically adsorbed onto the latent image part of photoconductor 20 in accordance with an electric field formed due to a balance between the electric potential of the electrostatic latent image on photoconductor 20 and the electric potential of developing roller 14, thereby developing the electrostatic latent image on photoconductor 20. As a result, a toner image corresponding to the shape of the electrostatic latent image is formed on the surface of photoconductor 20.

Intermediate transfer body 30 is disposed to face photoconductor 20, and is rotated in the direction of arrow AR30 in contact with photoconductor 20. The toner image adhering and held on photoconductor 20 is moved to a nip area (primary transfer position N1) between photoconductor 20 and intermediate transfer body 30, thereby primarily transferring it onto intermediate transfer body 30 at primary transfer position N1.

When primarily transferring the toner image adhering and held on photoconductor 20, a transfer bias voltage of polarity opposite to that of the toner particles is applied from a power source (not shown) to intermediate transfer body 30. Accordingly, an electric field is formed between intermediate transfer body 30 and photoconductor 20 in primary transfer position N1, thereby primarily transferring, onto intermediate transfer body 30, the toner image on the photoconductor 20. The toner image having been primarily transferred is carried by intermediate transfer body 30 until the secondary transfer described below is performed.

It should be noted that when primarily transferring the toner image onto intermediate transfer body 30, photoconductor cleaning device 23 removes toner remaining on photoconductor 20. In this way, next image formation can be performed.

Transferring roller 40 is disposed to face intermediate transfer body 30 with the conveying path for recording medium 90 being interposed therebetween, and is rotated in contact with intermediate transfer body 30 with recording medium 90 being interposed therebetween. Transferring roller 40 is pressed against intermediate transfer body 30 to form a nip portion (secondary transfer position N2) between transferring roller 40 and intermediate transfer body 30.

The toner image carried by intermediate transfer body 30 is secondarily transferred onto transfer surface 91 of recording medium 90, which has been conveyed in the conveying direction of recording medium 90 (direction of arrow AR90 in the figure), at the nip portion formed between transferring roller 40 and intermediate transfer body 30. Recording medium 90 is conveyed to second transfer position N2 at the timing of secondary transfer.

When secondarily transferring the toner image carried by intermediate transfer body 30, a transfer bias voltage of polarity opposite to that of the toner particles is applied from a power source (not shown) to transferring roller 40. Accordingly, an electric field is formed between intermediate transfer body 30 and transferring roller 40, thereby moving the toner image from intermediate transfer body 30 onto transfer surface 91 of recording medium 90 having passed through the portion between intermediate transfer body 30 and transferring roller 40. As a result, toner image 93 is secondarily transferred onto transfer surface 91 of recording medium 90. Recording medium 90 having toner image 93 secondarily transferred thereon is conveyed to fixing mechanism 2.

During the above-described secondary transfer, transfer surface 91 of recording medium 90 is charged to have the second polarity, i.e., negative polarity, opposite to that of the toner particles by pre-transfer processing apparatus 3 disposed upstream of secondary transfer position N2 in the conveying direction of recording medium 90 (direction of arrow AR90 in the figure). Accordingly, the toner particles having been moved onto transfer surface 91 of recording medium 90 are electrostatically adsorbed onto transfer surface 91 densely.

It should be noted that when the toner image is secondarily transferred onto transfer surface 91 of recording medium 90, intermediate transfer body cleaning device 31 removes toner remaining on intermediate transfer body 30. In this way, next image formation can be performed.

Here, the liquid developer used in the present embodiment contains a carrier liquid, which is a solvent, and colored toner particles. Additive agents, such as a dispersant and a charge control agent, may be appropriately selected and added in the liquid developer.

As the carrier liquid, silicone oil, mineral oil, or paraffin oil can be used, for example. The carrier liquid as described above can be classified as a solvent having an insulating property and not volatilized at an ordinary temperature, or a solvent having an insulating property and volatilized at the ordinary temperature. In the present embodiment, the solvent not volatilized at the ordinary temperature is distinguished as a "low-volatility carrier" whereas the solvent volatilized at the ordinary temperature is distinguished as a "high-volatility carrier".

Specific usable examples of the low-volatility carrier include: P-40 (flash point: 142° C.; provided by MORESCO); P-120 (flash point: 198° C.; provided by MORESCO); IP2028 (flash point: 86° C.; provided by Idemitsu Kosan Co., Ltd); IP-2835 (flash point: 139° C.; provided by Idemitsu Kosan Co., Ltd); IsoparM (flash point: 95° C.; provided by Exxon Mobil Corporation); and the like. In the present embodiment, the solvents each having a flash point of 70° C. or more correspond to the low-volatility carrier.

Although IP2028 is slightly volatilized at the ordinary temperature, it takes several ten seconds to be volatilized when the toner image is heated at approximately 100° C. by noncontact heating device 70. Hence, in the present embodiment, IP2028 cannot be sufficiently volatilized when fixing toner image 93. For this reason, it is assumed that IP2028 belongs to the low-volatility carrier.

Meanwhile, specific usable examples of the high-volatility carrier include: IsoparL (flash point 66° C.; provided by Exxon Mobil Corporation); IsoparH (flash point 54° C.; provided by Exxon Mobil Corporation); IsoparG (flash point 43° C.; provided by Exxon Mobil Corporation); IP-1620 (flash point: 49° C.; provided by Idemitsu Kosan Co., Ltd); and the like.

When the toner image is heated to approximately 100° C. by noncontact heating devices 70, most part of IsoparL is volatilized from the toner image.

A toner particle is constituted of a resin material and a pigment or dye for coloring. The resin material has a function of uniformly dispersing the pigment or dye in the resin material and a function of a binder when the toner particle is fixed onto recording medium 90. As the resin material, there can be used a resin material having a thermoplasticity, such as a polystyrene resin, a styrene acrylic resin, an acrylic resin, a polyester resin, an epoxy resin, a polyamide resin, a polyimide resin, or a polyurethane resin. As the resin material for toner particle, a plurality of resin materials selected from these may be mixed and used.

As the pigment or dye used to color the toner, a commercially available general pigment or dye can be used. As the pigment, carbon black, iron red, titanium oxide, silica, phthalocyanine blue, phthalocyanine green, sky blue, benzidine yellow, lake red D, or the like can be used. As the dye, solvent red 27, acid blue 9, or the like can be used.

As a method of preparing the liquid developer, a generally used method can be used. For example, first, the resin material and the pigment at a predetermined mixing ratio are melted and kneaded using a pressurizing kneader, a roll mill, or the like. Then, a dispersion body obtained by uniformly dispersing the resin material and the pigment is pulverized using a jet mill or the like. Next, fine powders resulting from the pulverization is classified using an air classifier or the like. Accordingly, colored toner having a predetermined particle size is obtained. Next, the obtained colored toner and an insulating liquid serving as the carrier liquid are mixed at a predetermined mixing ratio. This mixture is uniformly dispersed using dispersion means such as a ball mill. With the method above, the liquid developer is obtained.

The volume mean particle size of the toner particles in the liquid developer is preferably not less than 0.1 μm and not more than 5 μm. When the volume mean particle size of the toner particles in the liquid developer is 0.1 μm or more, development of electrostatic latent image by the toner particles is facilitated. When the volume mean particle size of the toner particles in the liquid developer is 5 μm or less, the toner-fixed image is improved in quality.

A ratio of the mass of the toner particles to the mass of the liquid developer is preferably not less than 10% and not more than 50%. When the ratio of the mass of the toner particles to the mass of the liquid developer is 10% or more, the toner particles are less likely to settle. The toner particles have high stability with respect to passage of time for a long-term storage, and attain reduction of a required amount of liquid developer to achieve a desired image density. This eliminates necessity of drying a large amount of carrier liquid when fixing the toner image, thereby preventing generation of a large amount of vapor from the carrier liquid. When the ratio of the mass of the toner particles to the mass of the liquid developer is 50% or less, the liquid developer has a viscosity appropriate in value and therefore is handled favorably during production thereof.

The liquid developer may have a viscosity of not less than 0.1 mPa·s and not more than 10000 mPa·s at 25° C. In the case where the liquid developer has a viscosity of 10000 mPa·s or less, the liquid developer can be readily handled when stirring or supplying the liquid developer, thereby reducing loads on devices for obtaining the uniform liquid developer.

Fixing mechanism 2 includes four noncontact heating devices 70, a removing mechanism 80, and a pressurizing and heating mechanism 50 serving as a fixing member. Noncontact heating devices 70, removing mechanism 80, and pressurizing and heating mechanism 50 are arranged sequentially in the conveying direction (arrow AR90 in the figure) of recording medium 90. Fixing mechanism 2 is disposed downstream of secondary transfer position N2 in the conveying path for recording medium 90.

Four noncontact heating devices 70 are arranged in the conveying direction of recording medium 90 (direction of AR90 in the figure) in the following manner. That is, two pairs of noncontact heating devices 70 are arranged side by side with each pair of noncontact heating devices 70 facing each other with the conveying path for recording medium 90 being interposed therebetween. Each of these noncontact heating devices 70 includes a noncontact heater 71 and a heat insulating cover 72.

Noncontact heaters 71 are disposed to face transfer surface 91 of recording medium 90 (its surface having toner image 93 transferred thereon) and face rear surface 92 opposite to transfer surface 91, so as to heat recording medium 90 and toner image 93 having been transferred on transfer surface 91 without contact with them.

By heating toner image 93 having been transferred on transfer surface 91, the toner particles in toner image 93 are melted and deformed. Meanwhile, when the high-volatile carrier liquid is used as carrier liquid 95 contained in toner image 93, most part of the high-volatile carrier liquid is volatilized. On the other hand, when the low-volatility carrier liquid is used as carrier liquid 95, most part of the low-volatility carrier liquid remains without being volatilized.

The temperature of the heating surface of each of noncontact heaters 71 is set at a desired temperature (such as 500° C. to 700° C.) by a control unit not shown. Each of noncontact heaters 71 employed herein is a heater, such as a ceramic heater, configured to emit far-infrared rays in consideration of a difference in optical absorption between transferred black toner on transfer surface 91 of recording medium 90 and the other portions (such as transferred toner of respective colors such as yellow, magenta, cyan, and the like on the recording medium or a non-image formation portion having no toner transferred thereon).

Heat insulating cover 72 is provided to cover noncontact heater 71 from a side opposite to the conveying path for recording medium 90 relative to noncontact heater 71. Heat insulating cover 72 keeps the temperature around noncontact heater 71 at a high temperature, thereby achieving improved heating efficiency of noncontact heater 71. As a material for heat insulating cover 72, there can be employed a material, such as a ceramic fiber, having a high heat insulating property and a high heat resistance. It should be noted that heat insulating cover 72 may not be necessarily provided. When heat insulating cover 72 is not necessary, it may not be disposed therein.

It has been described that four noncontact heating devices 70 are arranged, but the present invention is not limited to this. One or more noncontact heating devices may be arranged. For example, one noncontact heating device 70 may be provided to face one of transfer surface 91 and rear surface 92 of recording medium 90. Alternatively, a plurality of noncontact heating devices 70 may be arranged in a zigzag manner to face each other with the conveying path for recording medium 90 being interposed therebetween, or may be arranged side by side at the side facing transfer surface 91 or rear surface 92 of recording medium 90. The arrangement thereof can be changed appropriately.

Removing mechanism 80 is disposed between each noncontact heating device 70 and pressurizing and heating mechanism 50 in the conveying direction of recording medium 90. Removing mechanism 80 has a carrier liquid removing roller 81, a pressurizing roller 82, and a cleaning blade 83. Carrier liquid removing roller 81 and pressurizing roller 82 are arranged to face each other with the conveying path for recording medium 90 being interposed therebetween, and are rotated in contact with each other with recording medium 90 being interposed therebetween. Pressurizing roller 82 is pressed against carrier liquid removing roller 81, thereby forming a nip area N3 between pressurizing roller 82 and carrier liquid removing roller 81.

When recording medium 90 passes through nip area N3, carrier liquid removing roller 81 makes contact with toner image 93 heated by noncontact heating devices 70, thereby removing an excess of carrier liquid 95 from toner image 93. Carrier liquid 95 removed is scraped and collected by cleaning blade 83.

Each of carrier liquid removing roller 81 and pressurizing roller 82 includes: a metal core; a silicone rubber layer provided at the outer circumference of the core; and a releasing layer provided at the outer circumference of the silicone rubber layer and made of a fluorine-based resin.

Each of carrier liquid removing roller 81 and pressurizing roller 82 has both end sides rotatably supported by bearing members (not shown). Carrier liquid removing roller 81 and pressurizing roller 82 are supported by a pressing/separating mechanism (not shown), which has a cam, a spring, or the like, such that they can be pressed against each other in the conveying path for recording medium 90. The pressing/separating mechanism can switch between a state in which the carrier liquid can be removed and a state in which the carrier liquid cannot be removed.

For example, when a low-volatility carrier is used for the carrier liquid and toner image 93 is heated by noncontact heating devices 70 as described above, most part of the carrier liquid remains. Hence, it is preferable to remove an excess of the carrier liquid using removing mechanism 80. In this case, the pressing/separating mechanism is biased to press carrier liquid removing roller 81 and pressurizing roller 82 against each other in the conveying path for recording medium 90. Accordingly, removing mechanism 80 is brought into the state in which the carrier liquid can be removed.

On the other hand, when a high-volatility carrier is used for the carrier liquid, most part of the carrier liquid is volatilized by heating toner image 93 using noncontact heating devices 70 as described above. Hence, it is preferable not to use removing mechanism 80. In this case, the pressing/separating mechanism separates carrier liquid removing roller 81 and pressurizing roller 82 from each other. Accordingly, removing mechanism 80 is brought into the state in which the carrier liquid cannot be removed.

Pressurizing and heating mechanism 50 includes a fixing roller 51 and a pressurizing roller 52 disposed to face each other with the conveying path for recording medium 90 being interposed therebetween. Fixing roller 51 and pressurizing roller 52 are arranged such that their rotation axes are in parallel with each other. Fixing roller 51 and pressurizing roller 52 have axial ends provided with bearing members (not shown), which rotatably support fixing roller 51 and pressurizing roller 52.

Pressurizing roller 52 is further provided with a pressurizing mechanism (not shown) employing a spring or the like. Pressurizing roller 52 is biased toward the side of fixing roller 51 so as to be pressed against fixing roller 51 by the pressurizing mechanism at predetermined force. Accordingly, a pressing nip area N4 is formed between fixing roller 51 and pressurizing roller 52.

Further, pressurizing roller 52 is driven to rotate at a predetermined revolving speed by a driving mechanism (not shown). Fixing roller 51 receives pressing frictional force from pressurizing roller 52 and is rotated according to pressurizing roller 52. It should be noted that fixing roller 51 may be driven to rotate so as to rotate pressurizing roller 52 according to fixing roller 51.

Fixing roller 51 and pressuring roller 52 include a heater lamp 51H and a heater lamp 52H, respectively. The surface temperature of each of fixing roller 51 and pressurizing roller 52 is controlled at a desired temperature.

Each of fixing roller 51 and pressurizing roller 52 includes: a metal core; a silicone rubber layer provided at the outer circumference of the core; and a releasing layer provided at the outer circumference of the silicone rubber layer and made of a fluorine-based resin.

The metal core is formed of a member having a high thermal conductivity, such as aluminum. The silicone rubber layer is provided as an elastic layer so as to secure a pressing nip width. The releasing layer made of the fluorine-based resin is provided to improve releasability of the roller surface. The releasing layer made of the fluorine-based resin has a thickness of, for example, 10 μm to 50 μm, and is made of a material such as a PTFE (polytetrafluoroethylene) resin or a PFA (perfluoroalkoxy polymer) resin.

Recording medium 90 conveyed to pressurizing and heating mechanism 50 is heated and pressed at pressurizing nip area N4 between fixing roller 51 and pressurizing roller 52. On this occasion, the toner particles contained in toner image 93 is facilitated to be melted, whereby the toner particles are melted and combined with each other. Pressure is applied to the toner particles melted and combined with each other, thereby fixing toner image 93 onto transfer surface 91 of recording medium 90 and accordingly forming a toner-fixed image.

Here, carrier liquids can be classified into a low-volatility carrier liquid and a high-volatility carrier liquid as described above. Similarly, recording media can be classified into a recording medium having good permeability such as a paper medium and a recording medium having bad permeability such as a film medium. When fixing a toner image, a state of fixing differs depending on a combination of them. Examples of the paper medium include coated paper, high-quality paper, and the like. Examples of the film medium include a PET (polyethylene terephthalate) film and the like.

Generally, when a low-volatility carrier liquid and a paper medium having good permeability are used, the low-volatility carrier liquid permeates the paper medium to increase the toner density of the toner image having been transferred onto the paper medium. Hence, when fixing the toner image, the toner particles are likely to be melted and combined with each other, with the result that the low-temperature offset is less likely to take place.

On the other hand, when a low-volatility carrier liquid and a film medium having bad permeability are used, the low volatility-carrier liquid is less likely to permeate the film medium, with the result that the toner density of the toner image having been transferred onto the film medium is not increased and is substantially constant. Accordingly, when fixing the toner image, the toner particles are less likely to be melted and combined with each other, with the result that the low-temperature offset is likely to take place in which the toner particles in the carrier liquid adhere to the fixing roller.

When a high-volatility carrier liquid is used and either of a paper medium having good permeability and a film medium having bad permeability is used, most part of the high-volatility carrier liquid is volatilized, thereby increasing the toner density of the toner image having been transferred onto the recording medium. Accordingly, toner particles are likely to be melted and combined with each other when fixing the toner image, with the result that the low-temperature offset is less likely to take place.

However, if the amount of the carrier liquid becomes insufficient due to the volatilization of the high-volatility carrier liquid, the toner particles are facilitated to be melted when fixing the toner image but the amount of the carrier liquid serving as the release agent is small, with the result that part of the melted toner particles are divided at boundary portions between the toner particles by the fixing roller. This is likely to result in the high-temperature offset in which the divided toner particles adhere to the fixing roller.

Regarding this point, when a high-volatility carrier liquid and a film medium having bad permeability are used, the carrier liquid is less likely to permeate the film medium, with the result that a small amount of the carrier liquid comes out of the film medium when fixing the toner image under application of pressure.

Meanwhile, when a high-volatility carrier liquid and a paper medium having good permeability are used, the carrier liquid permeates the paper medium, with the result that when fixing the toner image under application of pressure, the carrier liquid comes out of the paper medium to presumably serve as a release agent.

Accordingly, when the high-volatility carrier liquid and the film medium having bad permeability are used, the high-temperature offset is likely to take place as compared with the case where the high-volatility carrier liquid and the paper medium having good permeability are used.

In wet-type image formation apparatus 100 according to the present embodiment, the use of the low-volatility carrier liquid and the film medium provides suppression of the low-temperature offset even when the low-temperature offset is likely to take place, and the use of the high-volatility carrier liquid and the film medium provides suppression of the high-temperature offset even when the high-temperature offset is likely to take place. The following describes a reason therefor.

Figure 2:
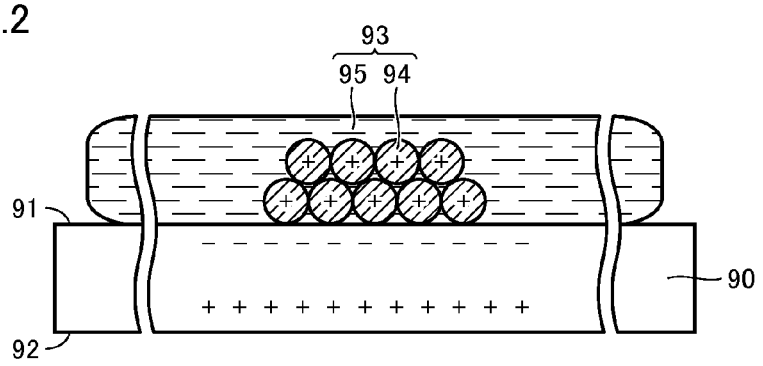
FIG. 2 is a schematic cross sectional view schematically showing a state of a recording medium and the like when transferring a toner image onto the recording medium by an intermediate transfer body shown in FIG. 1.
Figure 3:
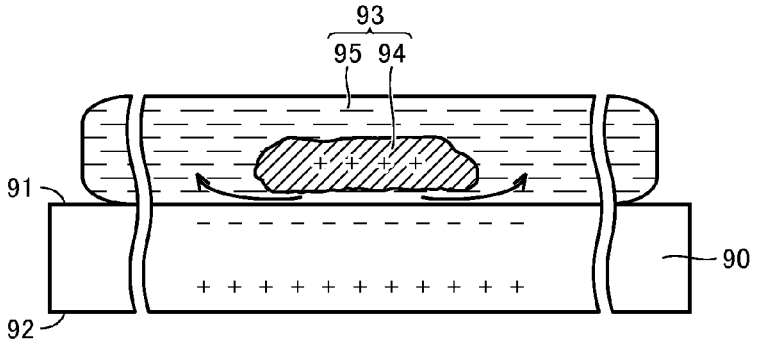
FIG. 3 is a schematic cross sectional view schematically showing a state of the recording medium and the like when the toner image transferred onto the recording medium as shown in FIG. 2 is heated by the noncontact heating device.
Figure 4:
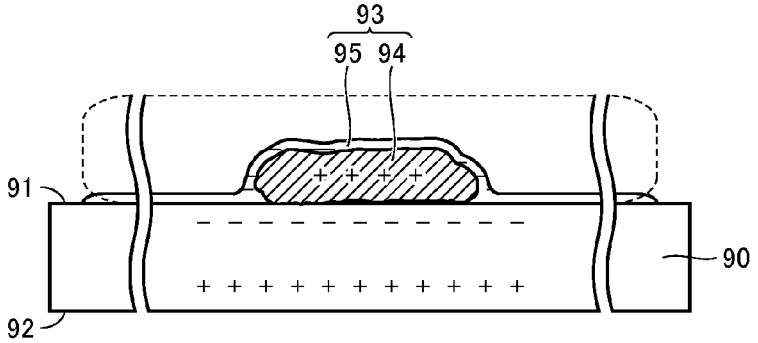
FIG. 4 is a schematic cross sectional view schematically showing a state of the recording medium and the like when part of carrier liquid is removed by a removing mechanism from the heated toner image shown in FIG. 3.
Figure 5:
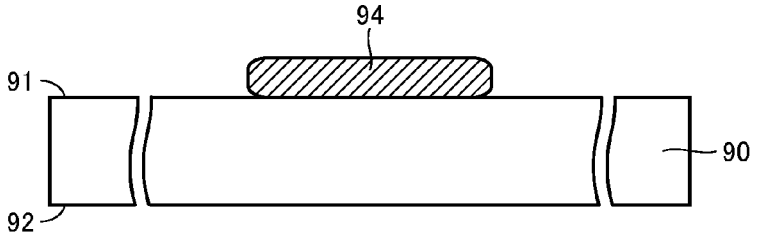
FIG. 5 is a schematic cross sectional view schematically showing a state of the recording medium and the like when the toner image from which part of the carrier liquid has been removed as shown in FIG. 4 is heated under application of pressure by the pressurizing and heating mechanism.

FIG. 2 is a schematic cross sectional view schematically showing a state of the recording medium and the like when the toner image is transferred to the recording medium by the intermediate transfer body. FIG. 3 is a schematic cross sectional view schematically showing a state of the recording medium and the like when the toner image transferred on the recording medium is heated by the noncontact heating devices. FIG. 4 is a schematic cross sectional view schematically showing a state of the recording medium and the like when part of the carrier liquid is removed from the heated toner image by the removing mechanism. FIG. 5 is a schematic cross sectional view schematically showing a state of the recording medium and the like when the toner image from which the part of the carrier liquid has been removed is heated by the pressurizing and heating mechanism under application of pressure. Referring to FIG. 2 to FIG. 5, the following describes the states thereof from the transfer to fixation of toner image 93 to recording medium 90.

It is assumed that a film medium having low permeability is used as recording medium 90, and FIG. 2 to FIG. 5 show the states of recording medium 90 and the like when a low-volatility carrier liquid is used.

As shown in FIG. 2, before recording medium 90 is conveyed to secondary transfer position N2 (see FIG. 1), transfer surface 91 of recording medium 90 is negatively charged and rear surface 92 thereof opposite to transfer surface 91 is positively charged by corotrons 62, 63. Meanwhile, toner particles 94 contained in the toner image primarily transferred to intermediate transfer body 30 are positively charged by charging device 15 of liquid developing device 10 before the primary transfer. Such a state is common in both the cases of using the low-volatility carrier liquid and the high-volatility carrier liquid.

Hence, when recording medium 90 is conveyed to secondary transfer position N2 and the toner image is secondarily transferred onto recording medium 90, toner particles 94 moved to transfer surface 91 of recording medium 90 based on the bias voltage applied to each of intermediate transfer body 30 and transferring roller 40 are attracted onto transfer surface 91 by Coulomb force between transfer surface 91, which is negatively charged, and toner particles 94. Accordingly, toner particles 94 are electrostatically adsorbed onto transfer surface 91 uniformly and densely.

As shown in FIG. 3, when the low volatility-carrier liquid is used and toner image 93 secondarily transferred is heated by noncontact heating devices 70, toner particles 94 are heated while being attracted onto transfer surface 91 uniformly and densely due to the Coulomb force, thereby incorporating the melted and deformed toner particles 94 into a film. Because the film of toner particles 94 are moved toward transfer surface 91 due to the Coulomb force, carrier liquid 95 between the film of toner particles 94 and transfer surface 91 is moved outside the film of toner particles 94. Accordingly, carrier liquid 95 is separated from the film of toner particles 94.

By thus separating carrier liquid 95 from the film of toner particles 94, there can be reduced an amount of carrier liquid 95 remaining in a space between toner particles 94 and a space between each toner particle 94 and transfer surface 91 of recording medium 90. As a result, when fixing toner image 93, remaining carrier liquid 95 can be suppressed from decreasing adhesive strength between toner image 93 and recording medium 90, thereby securing fixability of toner image 93.

Meanwhile, although not shown in the figure, also when the high-volatility carrier liquid is used and the film of toner particles 94 is electrostatically adsorbed on transfer surface 91 of recording medium 90, carrier liquid 95 between the film of toner particles 94 and transfer surface 91 of recording medium 90 is moved. Accordingly, toner particles 94 and carrier liquid 95 are separated from each other. When toner image 93 is heated using noncontact heating devices 70, most part of the high-volatility carrier liquid is volatilized.

As described above, noncontact heating devices 70 heat toner image 93 while toner particles 94 charged to have the first polarity are electrostatically adsorbed onto transfer surface 91 charged to have the second polarity, thereby forming toner particles 94 into the film so as to separate toner particles 94 and carrier liquid 95 from each other.

As shown in FIG. 4, when the low-volatility carrier liquid is used and part of carrier liquid 95 separated from heated toner image 93 by removing mechanism 80 is removed, toner particles 94 are formed into the film and adsorbed on transfer surface 91. Hence, the number of toner particles dispersed in carrier liquid 95 can be reduced, whereby toner particles 94 are less likely to adhere to carrier liquid removing roller 81 of removing mechanism 80. Accordingly, toner particles 94 can be suppressed from being separated from toner image 93, whereby the low-temperature offset can be suppressed also when removing an excess of carrier liquid 95.

As described above, removing mechanism 80 removes carrier liquid 95, which has been separated by forming toner particles 94 into the film using noncontact heating devices 70, before toner image 93 is fixed by pressurizing and heating mechanism 50.

On the other hand, when the high-volatility carrier liquid is used, most part of the carrier liquid is volatilized as described above. Hence, an excess of carrier liquid 95 does not need to be removed and therefore removing mechanism 80 does not need to be used. It should be noted that the film of toner particles 94 is adsorbed on transfer surface 91 in the same manner as described above.

As shown in FIG. 5, when the low-volatility carrier liquid is used and toner image 93 is heated under application of pressure by pressurizing and heating mechanism 50, the number of toner particles 94 dispersed in remaining carrier liquid 95 is reduced because toner particles 94 are in the form of film. Accordingly, when fixing toner image 93, toner particles 94 are less likely to adhere to fixing roller 51, thereby facilitating melting of the film of toner particles 94 to form an image. Because toner particles 94 can be thus suppressed from being separated from toner image 93, the low-temperature offset can be suppressed even when heating toner image 93 under application of pressure.

Further, the toner particles, which have been formed into the film when being electrostatically adsorbed and are likely to be melted, can be fixed onto transfer surface 91, thereby also improving the fixing strength. Further, because the toner particles are in the form of the film, there exists substantially no space (boundary portion) between the toner particles in the formed image portion. Hence, light from a light source is not reflected by the boundary, thus obtaining an image having a high degree of transparency.

Meanwhile, although not shown in the figure, when the high-volatility carrier liquid is used, substantially no carrier liquid 95 covering the film of toner particles 94 remains, with the result that toner image 93 is likely to be melted by pressurizing and heating mechanism 50. However, when toner particles 94 are in the form of the film, there exists substantially no space (boundary portion) between the toner particles. Hence, individual toner particles are less likely to be divided from their boundary portions when being brought in contact with the fixing roller. Accordingly, when fixing toner image 93, the film of toner particles 94 is facilitated to be melted with no adhesion of toner particles 94 to fixing roller 51, thus forming a toner-fixed image. Because toner particles 94 can be thus suppressed from being separated from toner image 93, the high-temperature offset can be suppressed even when heating toner image 93 under application of pressure. Further, as with the case described above, the film of the toner particles provides improved fixing strength and attains an image having a high degree of transparency.

With the configuration described above, wet-type image formation apparatus 100 according to the present embodiment is capable of suppressing the low-temperature offset that is likely to take place when the low-volatility carrier liquid is used, and is capable of suppressing the high-temperature offset that is likely to take place when the high-volatility carrier liquid is used. Further, in wet-type image formation apparatus 100 according to the present embodiment, toner particles 94 are formed into the film, which is then fixed onto transfer surface 91. This provides improved fixing strength and reduced roughness in the image portion, thereby obtaining an image having a high degree of transparency.

(Comparative Form)

Figure 6:
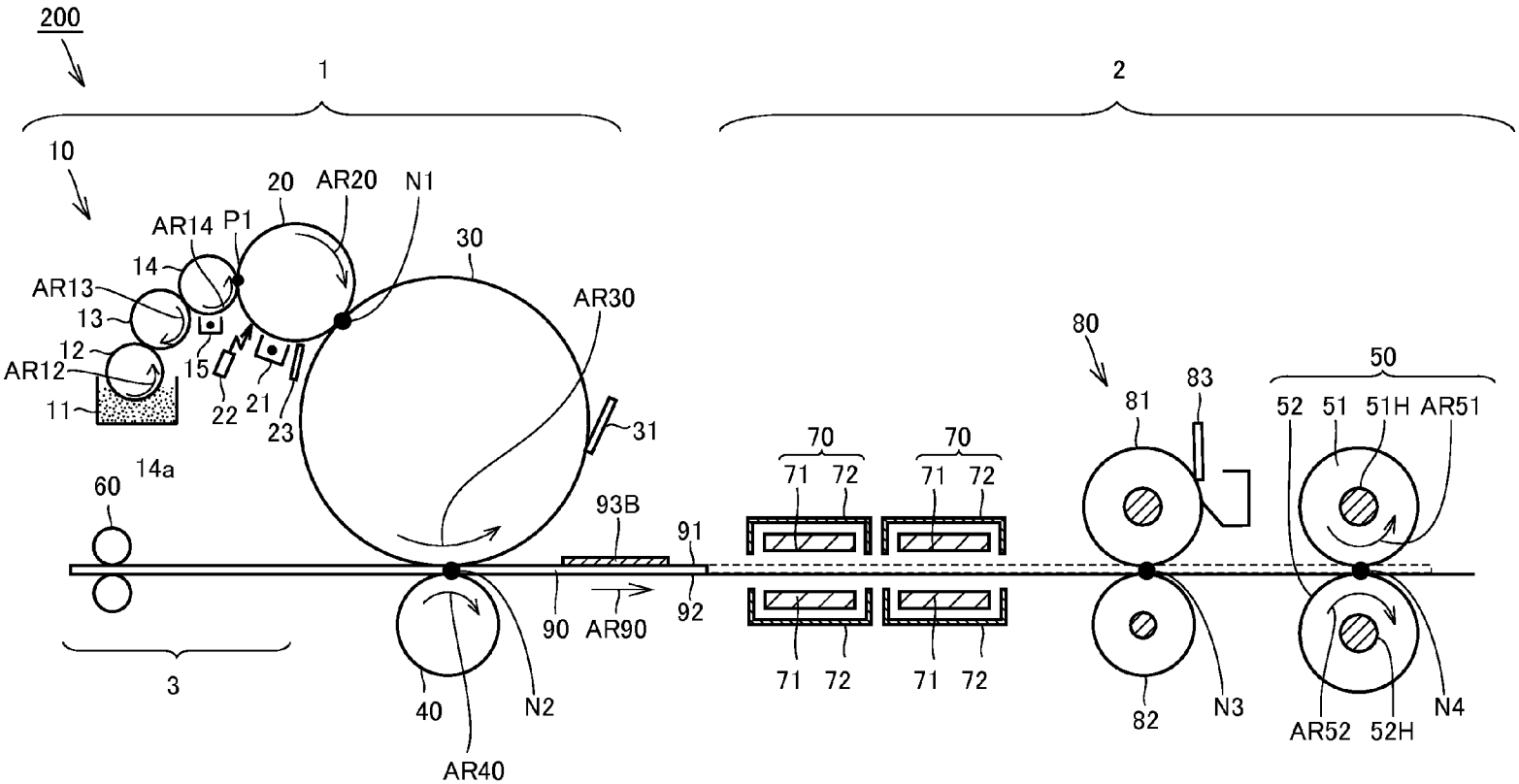
FIG. 6 is a schematic view of a wet-type image formation apparatus in a comparative form.

FIG. 6 is a schematic view of a wet-type image formation apparatus in a comparative form. With reference to FIG. 6, the following describes wet-type image formation apparatus 200 in the comparative form.

As shown in FIG. 6, wet-type image formation apparatus 200 in the comparative form is different from wet-type image formation apparatus 100 according to the first embodiment in that wet-type image formation apparatus 200 does not include charging device 61 that charges recording medium 90 before the secondary transfer. Accordingly, the states from the transfer to fixation of toner image 93B onto recording medium 90 in the present comparative form become different from those in the first embodiment. The other configurations are substantially the same as the configurations of wet-type image formation apparatus 100 according to the first embodiment.

Figure 7:
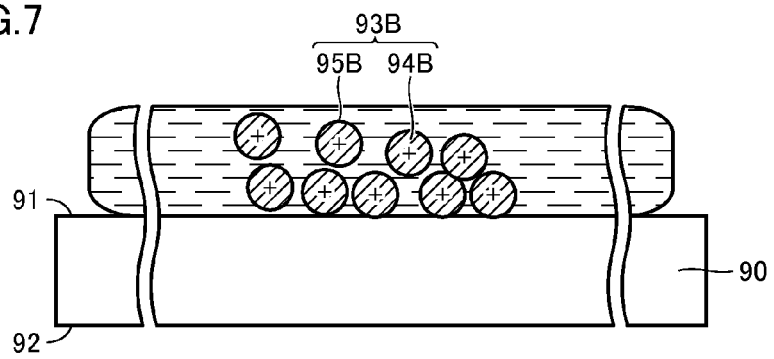
FIG. 7 is a schematic cross sectional view schematically showing a state of a recording medium and the like when transferring a toner image onto the recording medium by an intermediate transfer body shown in FIG. 6.
Figure 8:
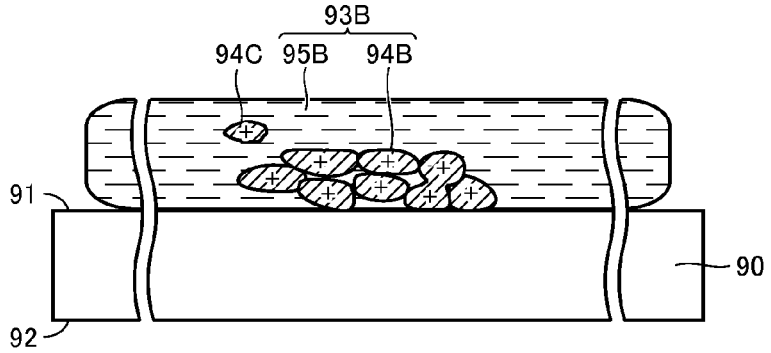
FIG. 8 is a schematic cross sectional view schematically showing a state of the recording medium and the like when the toner image transferred onto the recording medium as shown in FIG. 7 is heated by the noncontact heating device.
Figure 9:
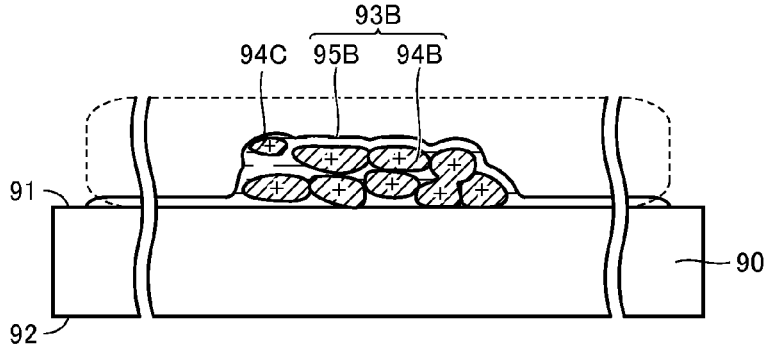
FIG. 9 is a schematic cross sectional view schematically showing a state of the recording medium and the like when part of carrier liquid is removed by a removing mechanism from the heated toner image shown in FIG. 8.
Figure 10:
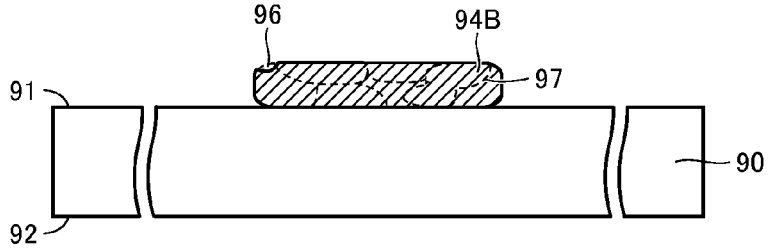
FIG. 10 is a schematic cross sectional view schematically showing a state of the recording medium and the like when the toner image from which part of the carrier liquid has been removed as shown in FIG. 9 is heated under application of pressure by the pressurizing and heating mechanism.

FIG. 7 is a schematic cross sectional view schematically showing a state of the recording medium and the like when the toner image is transferred to the recording medium by the intermediate transfer body. FIG. 8 is a schematic cross sectional view schematically showing a state of the recording medium and the like when the toner image transferred on the recording medium is heated by the noncontact heating devices. FIG. 9 is a schematic cross sectional view schematically showing a state of the recording medium and the like when part of the carrier liquid is removed from the heated toner image by the removing mechanism. FIG. 10 is a schematic cross sectional view schematically showing a state of the recording medium and the like when the toner image from which the part of the carrier liquid has been removed is heated by the pressurizing and heating mechanism under application of pressure. Referring to FIG. 7 to FIG. 10, the following describes the states thereof from the transfer to fixation of toner image 93 to recording medium 90 in the comparative form.

It is assumed that a film medium having low permeability is used as recording medium 90, and FIG. 7 to FIG. 10 show the states of recording medium 90 and the like when a low-volatility carrier liquid is used.

As shown in FIG. 7, before recording medium 90 is conveyed to secondary transfer position N2 (see FIG. 6), recording medium 90 has not been charged and only toner particles 94B contained in the toner image primarily transferred onto intermediate transfer body 30 have been charged positively by charging device 15 of liquid developing device 10 before the primary transfer. Such a state is common in both the cases of using the low-volatility carrier liquid and the high-volatility carrier liquid.

When recording medium 90 is conveyed to secondary transfer position N2 and the toner image is secondarily transferred onto recording medium 90, toner particles 94B are electrostatically adsorbed onto transfer surface 91 of recording medium 90 based on the bias voltage applied to each of intermediate transfer body 30 and transferring roller 40. On this occasion, transfer surface 91 of recording medium 90 has not been charged to have a polarity opposite to that of toner particles 94B, so that toner particles 94B are not densely adsorbed onto the transfer surface, are separated from each other, and are arranged with a space therebetween.

As shown in FIG. 8, when the low-volatility carrier liquid is used and secondarily transferred toner image 93B is heated using noncontact heating devices 70, toner particles 94B are less likely to be formed into a film because they are separated from each other, with the result that individual toner particles 94B melted and deformed overlap with each other with a space therebetween. Accordingly, toner particles 94C, which are part of individual toner particles 94B, are separated from the other toner particles 94B and are dispersed in the carrier liquid. Accordingly, toner particles 94B and carrier liquid 95B are not facilitated to be separated from each other, with the result that carrier liquid 95B remains in a space between toner particles 94B and a portion between toner particle 94B and transfer surface 91 of recording medium 90. Accordingly, when fixing toner image 93B, remaining carrier liquid 95B decreases the adhesive strength between toner image 93B and recording medium 90, with the result that fixability may not be secured.

Meanwhile, although not shown in the figure, when the high-volatility carrier liquid is used, most part of the carrier liquid is volatilized, but toner particles 94B are less likely to be formed into the film as described above and individual toner particles 94B melted and deformed overlap with each other with a space therebetween. Accordingly, toner particles 94B and carrier liquid 95B are not facilitated to be separated from each other.

As shown in FIG. 9, when the low-volatility carrier liquid is used and part of carrier liquid 95B separated from heated toner image 93B is removed by removing mechanism 80, toner particles 94C separated from the other toner particles 94B and dispersed in carrier liquid 95B are likely to adhere to carrier liquid removing roller 81. Accordingly, part of carrier liquid 95B may be removed with part of the toner particles being separated from toner image 93B. Accordingly, when removing an excess of carrier liquid 95B, the low-temperature offset is likely to take place. Further, the carrier liquid remaining to cover the surfaces of toner particles 94B serves as a release agent when fixing toner image 93B.

On the other hand, although not shown in the figure, when the high-volatility carrier liquid is used, most part of carrier liquid 95B is volatilized as described above. Hence, an excess of carrier liquid 95B does not need to be removed and therefore removing mechanism 80 does not need to be used.

As shown in FIG. 10, when the low-volatility carrier liquid is used and toner image 93B is heated under application of pressure by pressurizing and heating mechanism 50, toner particles 94C dispersed in remaining carrier liquid 95B exist because toner particles 94B are not in the form of film. Accordingly, when heating toner image 93B under application of pressure, dispersed toner particles 94C adhere to fixing roller 51, thereby facilitating melting of toner particles 94B with part of toner particles being separated from toner image 93B. A toner-fixed image is formed. As such, in wet-type image formation apparatus 200 of the comparative form, toner particles 94B are not facilitated to be formed into the film, which results in the low-temperature offset. It should be noted that in the toner-fixed image, a boundary portion 97 is formed between recess 96 and each toner particle. This recess 96 causes distortion of the image. Further, the toner particles are not formed into the film and are not sufficiently melted, so that there remains roughness in the image portion. Accordingly, the degree of transparency is decreased in the image.

Meanwhile, although not shown in the figure, when the high-volatility carrier liquid is used, substantially no carrier liquid 95B covering toner particles 94B remains, with the result that toner image 93B is likely to be melted by pressurizing and heating mechanism 50. In this case, toner particles 94B are not formed into the film, so that there are many spaces (boundary portions 97) between the toner particles. As a result, part of the toner particles in contact with fixing roller 51 are divided from their boundary portions 97 and accordingly adhere to fixing roller 51. Accordingly, with the part of the toner particles being separated from toner image 93B, the toner particles are facilitated to be melted and a toner-fixed image is formed. As such, in wet-type image formation apparatus 200 of the comparative form, toner particles 94B are not facilitated to be formed into a film, which results in occurrence of the high-temperature offset. Further, roughness remains in the image portion as with the case described above, with the result that the degree of transparency is decreased in the image.

(Modification)

Figure 11:
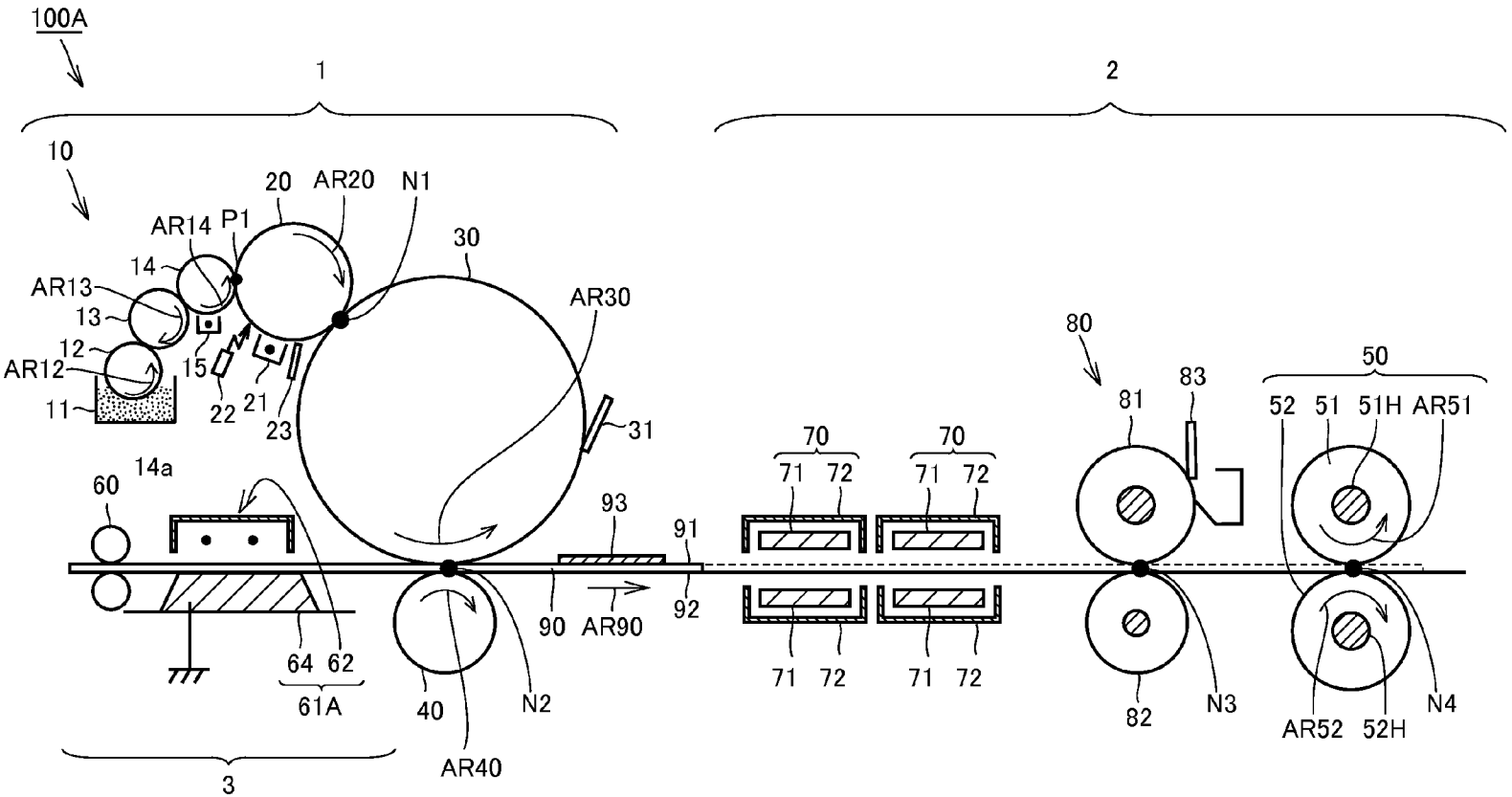
FIG. 11 is a schematic view of a wet-type image formation apparatus according to a modification of the present invention.

FIG. 11 is a schematic view of a wet-type image formation apparatus according to a modification. With reference to FIG. 11, the following describes wet-type image formation apparatus 100A according to the present modification.

As shown in FIG. 11, wet-type image formation apparatus 100A according to the present modification is different from wet-type image formation apparatus 100 according to the first embodiment in terms of the configuration of charging device 61A. The other configurations are substantially the same.

Specifically, charging device 61A of wet-type image formation apparatus 100A according to the present modification has a corotron 62 and a ground electrode 64 that face each other with the conveying path for recording medium 90 being interposed therebetween. Corotron 62 serves as a third corona charger.

Corotron 62 is disposed to face transfer surface 91 of recording medium 90, and charges transfer surface 91 to have the second polarity opposite to the first polarity of the charges of the toner particles. In this case, in order to negatively charge transfer surface 91 of recording medium 90, corotron 62 is fed with a negative high DC voltage by the power source (not shown), for example.

For example, ground electrode 64 is constructed of a flat plate electrode grounded to a peripheral member kept at a stable electric potential such as a ground potential. Further, ground electrode 64 is in abutment with rear surface 92 such that rear surface 92 of recording medium 90 opposite to transfer surface 91 slides on ground electrode 64. It should be noted that ground electrode 64 may be constructed of a conveying belt having electric conductivity and grounded to a stable electric potential. In this case, by revolving the conveying belt, recording medium 90 may be carried and conveyed.

With the configuration described above, also in wet-type image formation apparatus 100A according to the present modification, the secondary transfer is performed with transfer surface 91 of recording medium 90 being charged to have the polarity opposite to the polarity of the toner particles. Thereafter, heating is performed to form the toner particles into the film. Accordingly, wet-type image formation apparatus 100A according to the present modification provides substantially the same effect as that of wet-type image formation apparatus 100 according to the first embodiment.

Second Embodiment

Figure 12:
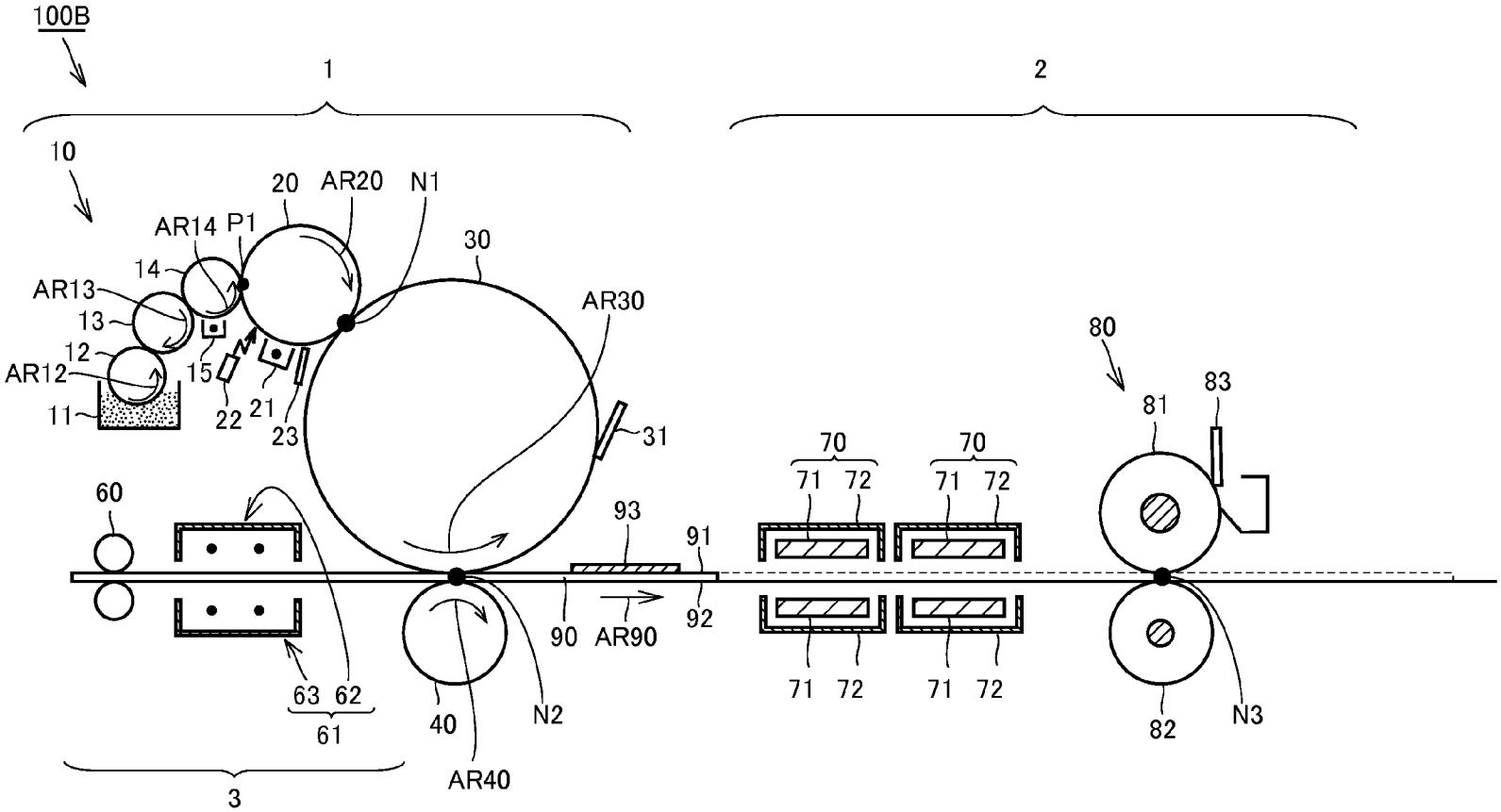
FIG. 12 is a schematic view of a wet-type image formation apparatus according to a second embodiment of the present invention.

FIG. 12 is a schematic view of a wet-type image formation apparatus according to the present embodiment. With reference to FIG. 12, the following describes wet-type image formation apparatus 100B according to the present embodiment.

As shown in FIG. 12, wet-type image formation apparatus 100B according to the present embodiment is different from wet-type image formation apparatus 100 according to the first embodiment in that wet-type image formation apparatus 100B does not include pressurizing and heating mechanism 50. The other configurations are substantially the same.

More specifically, fixing mechanism 2 of wet-type image formation apparatus 100B according to the present embodiment includes four noncontact heating devices 70 and a removing mechanism 80. Noncontact heating devices 70 heat toner image 93 while the toner particles charged to have a predetermined polarity are electrostatically adsorbed on the transfer surface charged to have a polarity opposite to the predetermined polarity. Accordingly, noncontact heating devices 70 form toner particles into a film such that the toner particles and the carrier liquid are separated from each other, and fix it onto transfer surface 91.

For example, when the low-volatility carrier liquid is used, after the film of the toner particles is fixed on transfer surface 91, the carrier liquid separated to the surface side of toner image 93 is removed by removing mechanism 80.

On the other hand, when the high-volatility carrier liquid is used and the film of the toner particles is fixed on transfer surface 91, most part of the carrier liquid is volatilized. Hence, an excess of carrier liquid 95 does not need to be removed and therefore removing mechanism 80 does not need to be used.

With the configuration described above, also in wet-type image formation apparatus 100B according to the present embodiment, the secondary transfer is performed with transfer surface 91 of recording medium 90 being charged to have the polarity opposite to the polarity of the toner particles. Thereafter, heating is performed to form the toner particles into the film. Accordingly, wet-type image formation apparatus 100B according to the present embodiment provides substantially the same effect as wet-type image formation apparatus 100 according to the first embodiment. Further, wet-type image formation apparatus 100B according to the present embodiment does not include the pressurizing and heating mechanism, so that the offset can be suppressed more securely.

EXAMPLES

FIG. 13 shows condition and result of an experiment conducted to verify the effect of the present invention. With reference to FIG. 13, the following describes a verification experiment conducted for the first and second embodiments and the modification.

For examples 1 and 3 and comparative examples 1 to 6 shown in FIG. 13, a toner-fixed image was formed using wet-type image formation apparatus 100 according to the first embodiment. For comparative examples 1 to 6, wet-type image formation apparatus 100 according to the first embodiment was used but some conditions were changed in forming the toner-fixed image. For example 2, wet-type image formation apparatus 100A according to the modification is used in forming the toner-fixed image. For examples 4 and 5 and comparative examples 7 to 10, a toner-fixed image was formed using wet-type image formation apparatus 100B according to the second embodiment. For comparative examples 7 to 10, wet-type image formation apparatus 100B according to the second embodiment was used but some conditions were changed in forming the toner-fixed image.

Based on the conditions shown in FIG. 13, the toner fixed-image formed on recording medium 90 was evaluated for each of examples 1 to 5 and comparative examples 1 to 10. In doing so, the size of the toner-fixed image was set as follows: the vertical size was 3 cm and the horizontal size was 3 cm. For evaluation of the toner-fixed image, evaluations on the low-temperature offset and the high-temperature offset and an evaluation on the degree of transparency were conducted. It should be noted that each of examples 4, 5 and comparative examples 7 to 10 employed wet-type image formation apparatus 100B according to the second embodiment, which included no pressurizing and heating mechanism and can suppress the offset. Hence, only the evaluation on the degree of transparency was conducted.

The evaluations on the low-temperature offset and the high-temperature offset were made as follows. Whether the toner particles adhering to fixing roller 51 after fixing the toner image onto the recording medium was visually observed. No adhesion of toner particles to fixing roller 51 was determined as "Good", whereas adhesion of toner particles thereto was determined as "Bad". It should be noted that the evaluation on the low-temperature offset was made under the condition that the temperature of fixing roller 51 was set at 70° C. when the toner image was fixed, and the evaluation on the high-temperature offset was made under the condition that the temperature of fixing roller 51 was set at 100° C. when the toner image was fixed.

The evaluation on the degree of transparency was made as follows. It was checked whether when the toner-fixed image on recording medium 90 was subjected to a light source (room light) or the like, light from the light source passes through the toner-fixed image. Passage of the light therethrough was determined as "Good". No passage of the light therethrough was determined as "Bad". With this evaluation on the degree of transparency, it can be checked whether or not the toner particles are in the form of film.

When the toner particles were in the form of film, substantially no space (boundary portion) existed between the toner particles as described above. Hence, light from the light source was not reflected by the boundary. Accordingly, the light passed through the toner-fixed image formed by the film of the toner particles. Moreover, the film of the toner particles also provided improved fixing strength as described above.

Meanwhile, when the toner particles were not in the form of film, a space (boundary) existed between the toner particles as described above, so that the light from the light source was reflected at the boundary portion. Accordingly, the light could not pass through the toner-fixed image. Further, when the toner particles were not in the form of film, the toner particles were prevented from being melted, resulting in decreased fixing strength.

For the evaluation on the degree of transparency, the temperature of fixing roller 51 was set at 70° C. when fixing the toner image.

As described above, in examples 1 to 3 and comparative examples 1 to 6, when wet-type image formation apparatus 100 according to the first embodiment was used, recording medium 90 was sandwiched during conveyance with appropriate tension being kept by the two conveying rollers, intermediate transfer body 30 and transferring roller 40, carrier liquid removing roller 81 and pressurizing roller 82, and fixing roller 51 and pressurizing roller 52. The conveying speed of recording medium 90 on this occasion was set at 150 mm/sec. Further, when wet-type image formation apparatus 100A according to the modification was used in example 2 and when wet-type image formation apparatus 100B according to the second embodiment was used in each of examples 4, 5 and comparative examples 7 to 10, the conveying speed of recording medium 90 was set at 150 mm/sec as described above.

In each of examples 1 to 5 and comparative examples 1 to 10, a PET film was used as recording medium 90. The carrier liquid is less likely to permeate the PET film.

Further, as shown in FIG. 13, when noncontact heating devices 70 were used, it is illustrated as "ON" with regard to the noncontact heating devices. The temperature of noncontact heating device 70 on this occasion was set at 500° C. Further, the range of heating by noncontact heating devices 70 in the conveying direction of recording medium 90 was set at a length of 40 cm. Recording medium 90 was heated for 2.7 seconds by noncontact heating devices 70. On this occasion, the temperature of the toner image when coming out of noncontact heating devices 70 was approximately 130° C. On the other hand, when noncontact heating devices 70 were not used, it is illustrated as "OFF" and in this case, noncontact heating devices 70 were not provided with electric power.

Further, in the present verification experiment, two types of carrier liquids were used: P-40 was used for the low-volatility carrier liquid and IsoparL was used for the high-volatility carrier liquid. It should be noted that when the low-volatility carrier liquid (P-40) was used, removing mechanism 80 was used to remove an excess of carrier liquid. On the other hand, when the high-volatility carrier liquid (IsoparL) was used, removing mechanism 80 was not used.

Example 1

For example 1, as the carrier liquid, P-40 having low volatility was used. Moreover, corotron 62 and corotron 63 were used as charging device 61. The polarity of the toner particles was positive. Corotron 62 was fed with a voltage of −5 kV and corotron 63 was fed with a voltage of +5 kV. The polarity of transfer surface 91 of recording medium 90 was set as negative before the secondary transfer. Moreover, noncontact heating device 70 was set at the ON state. In this case, the evaluation on the low-temperature offset was determined as "Good", the evaluation on the high-temperature offset was determined as "Good", and the evaluation on the degree of transparency was determined as "Good". Thus, a toner-fixed image having good quality was obtained.

Example 2

Example 2 is different from example 1 in that corotron 62 and ground electrode 64 were used as charging device 61. The other conditions of example 2 were the same as those of example 1. It should be noted that corotron 62 was fed with a voltage of −5 kV to provide transfer surface 91 of recording medium 90 with the negative polarity. In this case, the evaluation on the low-temperature offset was determined as "Good", the evaluation on the high-temperature offset was determined as "Good", and the evaluation on the degree of transparency was determined as "Good". Thus, a toner-fixed image having good quality was obtained.

Example 3

Example 3 is different from example 1 in that IsoparL having high volatility was used as the carrier liquid and no removing mechanism 80 was provided. The other conditions of example 3 were the same as those of example 1. In this case, the evaluation on the low-temperature offset was determined as "Good", the evaluation on the high-temperature offset was determined as "Good", and the evaluation on the degree of transparency was determined as "Good". Thus, a toner-fixed image with good quality was obtained.

Example 4

Example 4 is different from example 1 in that no pressurizing and heating mechanism was used. The other conditions of example 4 were the same as those of example 1. In this case, the evaluation on the degree of transparency was determined as "Good" and a toner-fixed image having good quality was obtained.

Example 5

Example 5 is different from example 3 in that no pressurizing and heating mechanism was used. The other conditions of example 5 were the same as those of example 3. In this case, the evaluation on the degree of transparency was determined as "Good" and a toner-fixed image having good quality was obtained.

Comparative Example 1

Comparative example 1 is different from example 1 in that no voltage is applied to corotron 62 and corotron 63. The other conditions of comparative example 1 were the same as those of example 1. In this case, the evaluation on the low-temperature offset was determined as "Bad", the evaluation on the high-temperature offset was determined as "Good", and the evaluation on the degree of transparency was determined as "Bad". In other words, in comparative example 1, the toner particles were not formed into the film and the low-temperature offset took place.

Comparative Example 2

Comparative example 2 is different from example 3 in that no voltage is applied to corotron 62 and corotron 63. The other conditions of comparative example 2 were the same as those of example 3. In this case, the evaluation on the low-temperature offset was determined as "Good", the evaluation on the high-temperature offset was determined as "Bad", and the evaluation on the degree of transparency was determined as "Bad". In other words, in comparative example 2, the toner particles were not formed into the film and the high-temperature offset took place.

Comparative Example 3

Comparative example 3 is different from example 1 in that corotron 62 was fed with a voltage of +5 kV, corotron 63 was fed with a voltage of −5 kV, and the polarity of transfer surface 91 of recording medium 90 was positive. The other conditions of comparative example 3 were the same as those of example 1. In this case, the evaluation on the low-temperature offset was determined as "Bad", the evaluation on the high-temperature offset was determined as "Good", and the evaluation on the degree of transparency was determined as "Bad". In other words, in comparative example 3, the toner particles were not formed into the film and the low-temperature offset took place.

Comparative Example 4

Comparative example 4 is different from example 3 in that corotron 62 was fed with a voltage of +5 kV, corotron 63 was fed with a voltage of −5 kV, and the polarity of transfer surface 91 of recording medium 90 was positive. The other conditions of comparative example 4 were the same as those of example 3. In this case, the evaluation on the low-temperature offset was determined as "Good", the evaluation on the high-temperature offset was determined as "Bad", and the evaluation on the degree of transparency was determined as "Bad". In other words, in comparative example 4, the toner particles were not formed into the film and the high-temperature offset took place.

Comparative Example 5

Comparative example 5 is different from example 1 in that the noncontact heating device was turned OFF. The other conditions of comparative example 5 were the same as those of example 1. In this case, the evaluation on the low-temperature offset was determined as "Bad", the evaluation on the high-temperature offset was determined as "Bad", and the evaluation on the degree of transparency was determined as "Bad". In other words, in comparative example 5, the toner particles were not formed into the film and the low-temperature offset and high-temperature offset took place.

Comparative Example 6

Comparative example 6 is different from example 3 in that the noncontact heating device was turned OFF. The other conditions of comparative example 6 were the same as those of example 3. In this case, the evaluation on the low-temperature offset was determined as "Bad", the evaluation on the high-temperature offset was determined as "Bad", and the evaluation on the degree of transparency was determined as "Bad". In other words, in comparative example 6, the toner particles were not formed into the film and the low-temperature offset and high-temperature offset took place.

Comparative Example 7

Comparative example 7 is different from example 4 in that no voltage is applied to corotron 62 and corotron 63. The other conditions of comparative example 7 were the same as those of example 4. In this case, the evaluation on the degree of transparency was determined as "Bad". In other words, in comparative example 7, the toner particles were not formed into the film and predetermined fixing strength was not secured, with the result that a toner-fixed image having a low degree of transparency was formed.

Comparative Example 8

Comparative example 8 is different from example 4 in that corotron 62 was fed with a voltage of +5 kV, corotron 63 was fed with a voltage of −5 kV, and the polarity of transfer surface 91 of recording medium 90 was positive. The other conditions of comparative example 8 were the same as those of example 4. In this case, the evaluation on the degree of transparency was determined as "Bad". In other words, in comparative example 8, the toner particles were not formed into the film and predetermined fixing strength was not secured, with the result that a toner-fixed image having a low degree of transparency was formed.

Comparative Example 9

Comparative example 9 is different from example 5 in that no voltage is applied to corotron 62 and corotron 63. The other conditions of comparative example 9 were the same as those of example 5. In this case, the evaluation on the degree of transparency was determined as "Bad". In other words, in comparative example 9, the toner particles were not formed into the film and predetermined fixing strength was not secured, with the result that a toner-fixed image having a low degree of transparency was formed.

Comparative Example 10

Comparative example 10 is different from example 5 in that corotron 62 was fed with a voltage of +5 kV, corotron 63 was fed with a voltage of −5 kV, and the polarity of transfer surface 91 of recording medium 90 was positive. The other conditions of comparative example 10 were the same as those of example 5. In this case, the evaluation on the degree of transparency was determined as "Bad". In other words, in comparative example 10, the toner particles were not formed into the film and predetermined fixing strength was not secured, with the result that a toner-fixed image having a low degree of transparency was formed.

From the results of example 1 and comparative examples 1, 3, 5, it is studied that when the low-volatility carrier liquid is used, the toner particles are formed into a film to improve the degree of transparency of the toner-fixed image and suppress the low-temperature offset by transferring the toner image onto transfer surface 91 and heating the transferred toner image using the noncontact heating devices with transfer surface 91 of recording medium 90 being charged to have a polarity opposite to that of the toner particles.

From the results of example 4 and comparative examples 7, 8, it is studied that when the low-volatility carrier liquid is used, the toner particles are formed into a film to improve the degree of transparency of the toner-fixed image by transferring the toner image onto transfer surface 91 and heating the transferred toner image using the noncontact heating devices with transfer surface 91 of recording medium 90 being charged to have a polarity opposite to that of the toner particles.

From the results of example 3 and comparative examples 2, 4, 6, it is studied that when the high-volatility carrier liquid is used, the toner particles are formed into a film to improve the degree of transparency of the toner-fixed image and suppress the high-temperature offset by transferring the toner image onto transfer surface 91 and heating the transferred toner image using the noncontact heating devices with transfer surface 91 of recording medium 90 being charged to have a polarity opposite to that of the toner particles.

From the results of example 5 and comparative examples 9, 10, it is studied that when the high-volatility carrier liquid is used, the toner particles are formed into a film to improve the degree of transparency of the toner-fixed image by transferring the toner image onto transfer surface 91 and heating the transferred toner image using the noncontact heating devices with transfer surface 91 of recording medium 90 being charged to have a polarity opposite to that of the toner particles.

From the results of examples 1 to 5, it is studied that the toner particles are formed into a film to improve the degree of transparency of the toner-fixed image and suppress the low-temperature offset and the high-temperature offset by transferring the toner image onto transfer surface 91 with transfer surface 91 of recording medium 90 being charged to have a polarity opposite to that of the toner particles, thereafter performing noncontact heating, and thereafter fixing the toner image. Further, from the results of examples 1 to 5, it is studied that a predetermined fixing strength is also secured with the toner particles being formed into the film.

From the results of the study and experiment example, it is empirically confirmed that with the configurations of wet-type image formation apparatuses 100, 100B, and 100A of the first and second embodiments and the modification, the offset can be suppressed, the fixing strength can be secured, and the degree of transparency can be improved by forming the toner particles into the film.

As described above, in each of the first and second embodiments and modification of the present invention, it has been illustrated that the carrier liquid separated by forming the toner particles into a film using noncontact heating devices 70 is removed using removing mechanism 80, but the present invention is not limited to this. The separated carrier liquid may be removed using only noncontact heating devices 70. In this case, the wet-type image formation apparatus is configured to increase the time of heating performed by noncontact heating devices 70, and the conveying speed is decreased and the number of noncontact heating devices 70 is increased, for example.

Further, as described above, in the first and second embodiments and modification of the present invention, it has been illustrated that one liquid developing device 10 is provided, but the present invention is not limited to this and two or more liquid developing devices 10 may be provided. In this case, there may be selected toner appropriately colored so as to correspond to a desired color of a toner-fixed image finally formed. For example, in the case where four liquid developing devices 10 are provided, four types of toner of cyan, magenta, yellow, and black can be used.

Meanwhile, as described above, in the first and second embodiments and modification of the present invention, it has been illustrated that the charger used for charging device 61 is a corotron charging the recording medium in a noncontact manner, but the present invention is not limited to this. The charger may be a metal roller coated with a conductive elastic member. In such an embodiment, the two metal rollers are arranged to face each other with the conveying path for the recording medium being interposed therebetween, so as to sandwich recording medium 90 and send it to the secondary transfer position. In this case, transfer surface 91 of recording medium 90 can be charged to have a polarity opposite to that of the toner particle by feeding the metal roller at the side of transfer surface 91 of recording medium 90 with high DC voltage having the polarity opposite to that of the toner particles and by grounding the metal roller at the rear surface 92 side to a stable potential. Meanwhile, in the modification, the above-described metal roller is provided instead of corotron 62.

Further, as described above, in the first and second embodiments and modification of the present invention, it has been illustrated that charging device 61 is provided between conveying means 60 and secondary transfer position N2, but the present invention is not limited to this. Charging device 61, conveying means 60, and secondary transfer position N2 may be provided in this order along the conveying path for recording medium 90. In this case, the surface of the conveying roller constituting conveying means 60 is preferably coated with an insulating member. Accordingly, the charges provided by charging device 61 are maintained up to the secondary transfer position without being removed by conveying means 60.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet-type image formation apparatus that forms a toner-fixed image on a recording medium while conveying said recording medium, comprising:

an image carrier that carries a toner image including toner particles, which are charged to have a first polarity, and a carrier liquid;

a transfer mechanism that is disposed to face said image carrier with a conveying path for said recording medium being interposed therebetween, that forms a nip portion between said transfer mechanism and said image carrier when being pressed against said image carrier, and that transfers said toner image carried by said image carrier onto a transfer surface of said recording medium conveyed to said nip portion;

a charging device that charges said transfer surface to have a second polarity opposite to said first polarity before said recording medium is conveyed to said nip portion, said charging device having a first member and a second member facing each other with the conveying path for said recording medium being interposed therebetween; and a fixing mechanism that fixes said toner image transferred onto said transfer surface, said fixing mechanism including a noncontact heating device that heats said toner image without contact with said toner image transferred onto said transfer surface, said noncontact heating device forming said toner particles into a film such that said toner particles and said carrier liquid are separated from each other by heating said toner image when said toner particles having been charged to have said first polarity are electrostatically adsorbed onto said transfer surface charged to have said second polarity, the film of said toner particles being fixed on said transfer surface.

2. The wet-type image formation apparatus according to claim 1, wherein said charging device includes a pair of corona chargers facing each other with the conveying path for said recording medium being interposed therebetween, one of said pair of corona chargers is disposed at a side of said transfer surface of said recording medium to charge said transfer surface to have said second polarity, and the other of said pair of corona chargers is disposed at a side opposite to said transfer surface of said recording medium to charge a surface of said recording medium, which is opposite to said transfer surface, to have said first polarity.

3. The wet-type image formation apparatus according to claim 1, wherein said charging device includes a corona charger and a ground electrode facing each other with the conveying path for said recording medium being interposed therebetween, said corona charger is disposed at a side of said transfer surface of said recording medium to charge said transfer surface to have said second polarity, and said ground electrode is in abutment with a surface of said recording medium opposite to said transfer surface such that the surface of said recording medium opposite to said transfer surface slides on said ground electrode.

4. The wet-type image formation apparatus according to claim 1, wherein said fixing mechanism further includes a pressurizing and heating mechanism disposed downstream of said noncontact heating device in the conveying direction of said recording medium, and said pressurizing and heating mechanism presses and heats the film of said toner particles.

5. The wet-type image formation apparatus according to claim 1, further comprising a removing mechanism that removes said carrier liquid separated by forming said toner particles into the film using said noncontact heating device.

6. The wet-type image formation apparatus according to claim 5, wherein said removing mechanism is configured to be switched between a state in which said carrier liquid is able to be removed and a state in which said carrier liquid is not able to be removed.

7. The wet-type image formation apparatus according to claim 1, wherein the transfer mechanism and the charging device are configured such that said toner image is transferred onto a uniformly charged transfer surface of the recording medium.

8. The wet-type image formation apparatus according to claim 1, further comprising a charger for charging the image carrier.

9. The wet-type image formation apparatus according to claim 8, further comprising an exposure device for exposing an image on the charged image carrier.

10. A method of forming a toner-fixed image on a recording medium while conveying said recording medium, comprising:

creating a toner image on an image carrier with toner particles which are charged to have a first polarity, and a liquid carrier;

uniformly charging a transfer surface of said recording medium to have a second polarity opposite to said first polarity;

conveying the recording medium having the uniformly charged transfer surface along a conveying path through a nip portion between the image carrier and a transfer mechanism such that the recording medium is pressed against said image carrier;

transferring said toner image carried by said image carrier onto the uniformly charged transfer surface of said recording medium conveyed to said nip portion; and fixing said toner image transferred onto said transfer surface with a noncontact heating device that heats said toner image without contact with said toner image transferred onto said transfer surface so as to form said toner particles into a film such that said toner particles and said carrier liquid are separated from each other by heating said toner image when said toner particles having been charged to have said first polarity are electrostatically adsorbed onto said transfer surface charged to have said second polarity, thus fixing the film of said toner particles on said transfer surface;

wherein the transfer surface is uniformly charged with a charging device that has a first member and a second member facing each other with the conveying path for said recording medium being interposed therebetween.

* * * * *